US008178767B1

(12) United States Patent
King

(10) Patent No.: US 8,178,767 B1
(45) Date of Patent: May 15, 2012

(54) PICK FOR PLAYING STRINGED MUSICAL INSTRUMENTS

(76) Inventor: Ron King, Granite Bay, CA (US)

( * ) Notice: Subject to any disclaimer, the term of this patent is extended or adjusted under 35 U.S.C. 154(b) by 59 days.

(21) Appl. No.: 12/925,382

(22) Filed: Oct. 20, 2010

Related U.S. Application Data

(63) Continuation-in-part of application No. 12/286,414, filed on Sep. 30, 2008, now Pat. No. 7,825,315.

(51) Int. Cl.
*G10D 3/16* (2006.01)

(52) U.S. Cl. ..... 84/322; 84/320

(58) Field of Classification Search ..... 84/320, 84/322

See application file for complete search history.

(56) References Cited

U.S. PATENT DOCUMENTS

| | | | | | |
|---|---|---|---|---|---|
| 567,447 | A | * | 9/1896 | Barrientos | 84/291 |
| 768,241 | A | | 8/1904 | Seidel | |
| 1,573,912 | A | * | 2/1926 | Burdwise | 84/322 |
| 2,459,274 | A | * | 1/1949 | Galetzky | 84/320 |
| 2,484,820 | A | * | 10/1949 | Galetzky | 84/322 |
| 2,961,912 | A | * | 11/1960 | Meola | 84/322 |
| 3,304,826 | A | | 2/1967 | Conradin | |
| 3,319,505 | A | * | 5/1967 | Galetzky | 84/322 |
| 3,595,118 | A | * | 7/1971 | Paxton | 84/322 |
| D260,529 | S | * | 9/1981 | Pearse | D17/20 |
| 4,993,301 | A | | 2/1991 | de los Santos | |
| D317,617 | S | * | 6/1991 | Mutti | D17/20 |
| 5,261,307 | A | | 11/1993 | Domanski | |
| D356,593 | S | | 3/1995 | Purcell | |
| D358,833 | S | | 5/1995 | Ridley et al. | |
| D369,615 | S | | 5/1996 | Latteri | |
| D395,330 | S | | 6/1998 | Sarno | |
| 6,133,516 | A | | 10/2000 | Hendrickson | |
| D444,167 | S | | 6/2001 | Charters | |
| D448,400 | S | | 9/2001 | Freeman | |
| D454,149 | S | | 3/2002 | Freeman | |
| 6,891,095 | B2 | | 5/2005 | Charters | |
| 7,459,620 | B1 | * | 12/2008 | Kester | 84/320 |
| 7,462,768 | B2 | * | 12/2008 | Newmaster | 84/322 |
| 7,825,315 | B1 | * | 11/2010 | King | 84/322 |
| 2004/0187668 | A1 | * | 9/2004 | Charters | 84/320 |
| 2004/0194607 | A1 | * | 10/2004 | Leong | 84/322 |
| 2005/0204893 | A1 | * | 9/2005 | Luschniu | 84/322 |
| 2005/0223872 | A1 | | 10/2005 | Greenwald | |
| 2007/0256533 | A1 | | 11/2007 | Newmaster | |
| 2008/0178725 | A1 | | 7/2008 | Goad | |
| 2009/0084244 | A1 | | 4/2009 | Goad | |

OTHER PUBLICATIONS

Stash Picks Wicked Pick Guitar Picks, viewed at http://www.samash.com/p/Wicked-Pick-Guitar-Picks-Bag-of-7_-49973774 on Feb. 13, 2010, made of record in parent U.S. Appl. No. 12/286,414.

* cited by examiner

*Primary Examiner* — Jeffrey Donels
*Assistant Examiner* — Robert W Horn
(74) *Attorney, Agent, or Firm* — Thomas R. Lampe

(57) ABSTRACT

A hand-held pick for playing guitars and other musical instruments includes a pick body and a plurality of string engaging protrusions. The pick body is flexible and may be used in either a straight condition or a bent condition. The protrusions can be simultaneously engaged with a plurality of strings and simultaneously pluck the strings.

8 Claims, 4 Drawing Sheets

PICK FOR PLAYING STRINGED MUSICAL INSTRUMENTS

This application is a continuation-in-part of U.S. patent application Ser. No. 12/286,414, filed Sep. 30, 2008 U.S. Pat. No. 7,825,315.

TECHNICAL FIELD

This invention relates to a hand-held pick for playing guitars and other musical instruments having a plurality of strings.

BACKGROUND OF THE INVENTION

Picks are well known devices for plucking the strings of guitars and other musical instruments, picks typically being utilized to engage and pluck strings individually and sequentially during play. A wide variety of picks of various shapes and sizes are well known, ranging from the standard pear-shaped pick to other more exotic picks or plectrums exemplified by the following prior art: U.S. Pat. No. 6,133,516, issued Oct. 17, 2000, U.S. Pat. No. 5,261,307, issued Nov. 16, 1993, U.S. Pat. No. 4,993,301, issued Feb. 19, 1991, U.S. Pat. No. 2,484,820, issued Oct. 18, 1949, U.S. Pat. No. 2,459,274, issued Jan. 18, 1949, U.S. Patent Application Pub. No. US 2007/0256533, published Nov. 8, 2007, U.S. Patent Application Pub. No. US 2005/0223872, published Oct. 13, 2005, U.S. Design Patent No. D454,149, issued Mar. 5, 2002, U.S. Design Patent No. D448,400, issued Sep. 25, 2001, U.S. Design Patent No. D395,330, issued Jun. 16, 1998, U.S. Design Patent No. D369,615, issued May 7, 1996, U.S. Design Patent No. D358,833, issued May 30, 1995, U.S. Design Patent No. D356,593, issued Mar. 21, 1995, U.S. Patent Application Pub. No. US 2009/0084244, published April, 2009, U.S. Patent Application Pub. No. US 2008/0178725, published July, 2008, U.S. Patent Application Pub. No. US 2005/0204893, published September, 2005, U.S. Pat. No. 6,891,095, issued May, 2005, U.S. Design Patent No. D444,167, issued June, 2001, U.S. Pat. No. 5,261,307, issued November, 1993, U.S. Design Patent No. D317,617, issued June, 1991, U.S. Pat. No. 3,319,505, issued May, 1967, U.S. Pat. No. 3,304,826, issued February, 1967, U.S. Pat. No. 2,484,820, issued October, 1949, U.S. Pat. No. 7,768,241, issued August, 1904, U.S. Pat. No. 567,447, issued September, 1896 and Stash Picks Wicked Pick Guitar Picks viewed at http://www.samash.com/p/Wicked-Pick-Guitar-Picks-Bag-of-7-49973774 on Feb. 13, 2010.

Some of the devices disclosed in the above-identified prior art utilize a plurality of jagged or serrated picking edges, while others employ a plurality of "fingers" which are utilized to strike only a single string, either in sequence or simultaneously. This approach severely limits tonal quality and does not begin to approximate the complex music produced by "finger plucking", that is, plucking of the strings by the player's fingers.

DISCLOSURE OF INVENTION

As will be described below in greater detail, the invention disclosed and claimed herein readily lends itself to simultaneously plucking a plurality of strings.

Furthermore, the prior art picks are generally relatively stiff, with any projections or fingers remaining fixed in position relative to one another and to the rest of the pick. In contrast, as will be described in greater detail below, the pick of this invention is manually bendable to provide various pick configurations during playing. This enables the player to obtain a wide variety of sounds and replicate techniques heretofore only obtainable by "finger picking."

In addition, dynamic range and volume are greatly increased through use of the present invention and a wide variety of guitar styles may be emulated. One can obtain a percussive, almost piano-like, effect. Prior art pick constructions do not have these capabilities. With the present invention, different chords and harmonics can be obtained and varied as the result of changing angles and orientations of the pick by simple wrist movement and the configuration of the device may be readily modified by bending and unbending the device by hand.

The present invention relates to a hand-held pick for playing guitars and other musical instruments having a plurality of strings. The hand-held pick includes an elongated pick body having a primary axis and a plurality of string engaging protrusions integral with the elongated pick body and extending outwardly from the elongated pick body in a direction generally orthogonal to the primary axis.

The protrusions are tapered, being defined by converging protrusion side walls and further defining notches between adjacent protrusions.

The hand-held pick in the absence of outside bending forces being applied thereto is in a first condition wherein the pick body and the protrusions are disposed in a common plane.

The hand-held pick is flexible and bendable upon application of bending forces thereto to cause the hand-held pick to assume a second condition wherein the pick body forms a bend generally orthogonal to the primary axis with at least some of the protrusions displaced relative to one another and not disposed in a common plane.

The hand-held pick is utilized in a method of playing a guitar or other musical instrument having a plurality of strings, the strings being spaced from one another.

According to the method, a hand-held pick is provided, the hand-held pick including an elongated pick body having a primary axis and a plurality of string engaging protrusions integral with the pick body disposed along the elongated pick body and extending outwardly from the elongated pick body in a direction generally orthogonal to the primary axis.

The hand-held pick is positioned with the plurality of string engaging protrusions extending toward the strings of a musical instrument.

During playing of the musical instrument, at least two of the plurality of string engaging protrusions are utilized to simultaneously selectively engage and pluck a plurality of the strings.

The method also encompasses the step of bending the hand-held pick to form a bend in the pick body generally orthogonal to the primary axis with at least some of the string engaging protrusions displaced relative to one another and not disposed in a common plane.

Other features, advantages and objects of the present invention will become apparent with reference to the following description and accompanying drawings.

MODES FOR CARRYING OUT THE INVENTION

Figure 13:
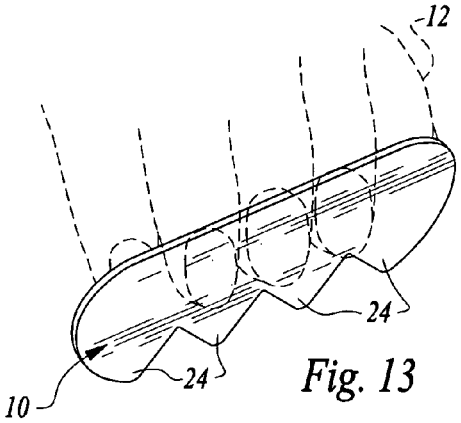
FIG. 13 is a perspective view of the first embodiment of the pick held by a user's hand, the pick being in an unbent condition with the pick body and string engaging protrusions thereof being disposed in a common plane.
Figure 14:
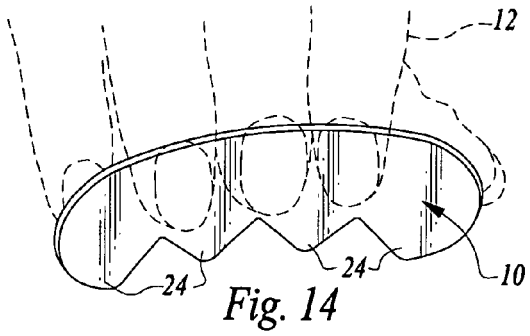
FIG. 14 is a perspective view of the hand-held pick of FIG. 13 being manually bent to provide a selected bent configuration.
Figure 15:
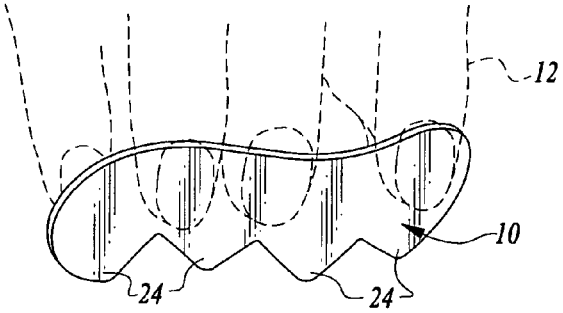
FIG. 15 is a view similar to FIG. 14, but illustrating the hand-held pick being manually bent to form an alternative bent configuration.
Figure 16:
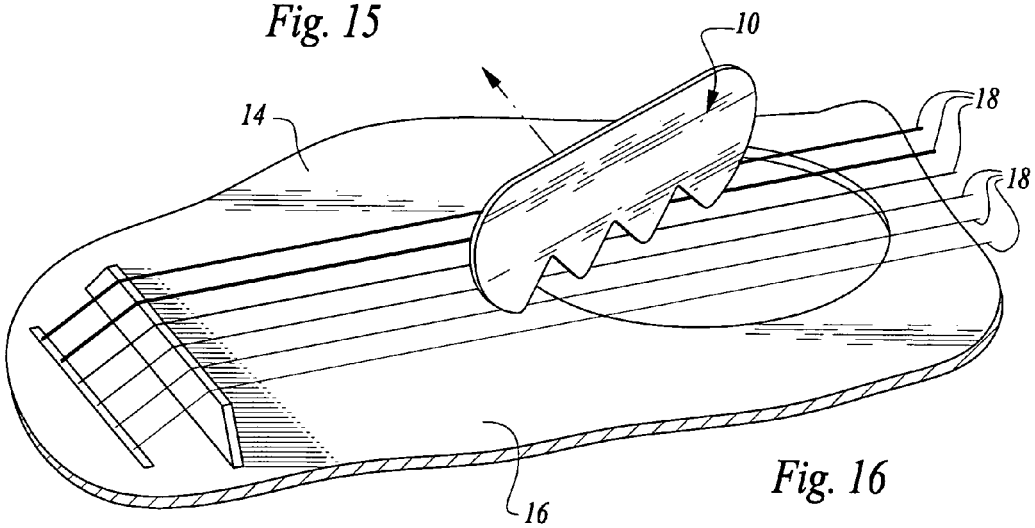
FIG. 16 is a perspective view illustrating the pick embodiment of FIG. 1 in unbent condition and moving in the direction of the illustrated arrow across strings of a guitar over the guitar body sound hole.
Figure 17:
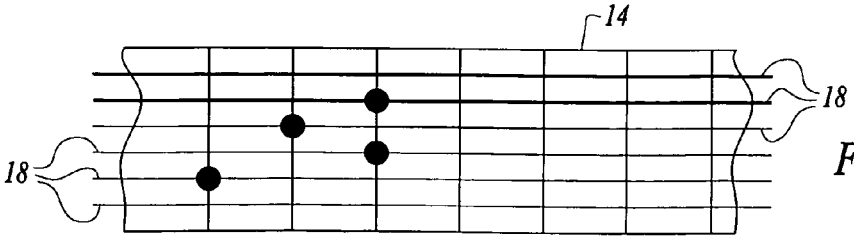
FIG. 17 is a top, plan view showing a portion of the guitar neck and strings and illustrating diagrammatically representative positioning of a user's fingers on the guitar strings of the neck when playing.
Figure 18:
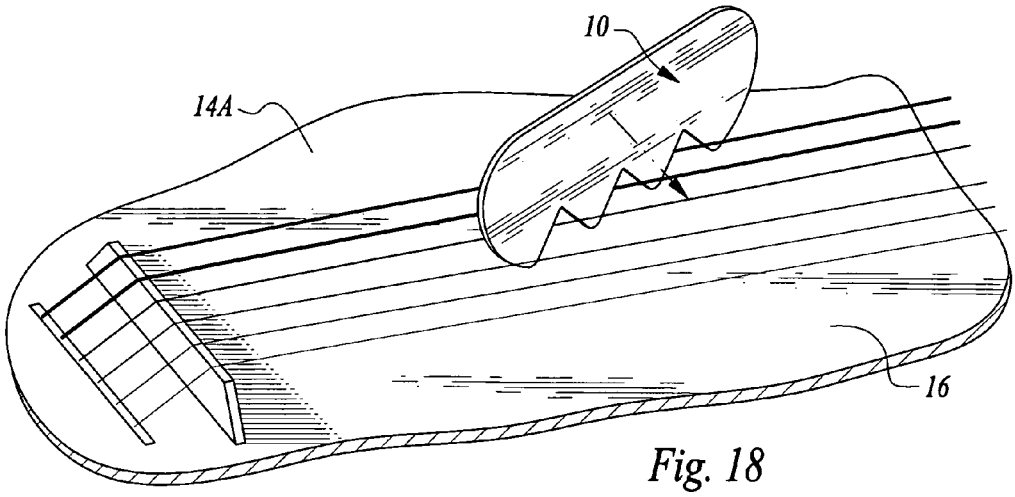
FIG. 18 is a view similar to FIG. 16, but illustrating the pick moving in the opposite direction over the strings of a guitar without a sound hole.

Referring now to FIGS. 1, 2 and 13-25, a preferred embodiment of a hand-held pick constructed in accordance with the teachings of the present invention is illustrated and identified by reference numeral 10. The hand-held pick is utilized for playing guitars and other musical instruments having a plurality of strings. FIGS. 13, 14 and 15, which will be discussed further below, show the pick 10 being held by a player's hand 12 illustrated by dash lines. FIGS. 16 and 18 respectively show the pick 10 in association with a guitar 14 with a sound hole and guitar 14A without a sound hole, the figures only illustrating a portion of the guitar body 16 and portions of guitar strings 18. As is conventional, the strings 18 are generally disposed in a common plane above the guitar body.

Figures 1, 2, 3, 4, 5, 6, 7, 8, 9, 10, 11, 12:
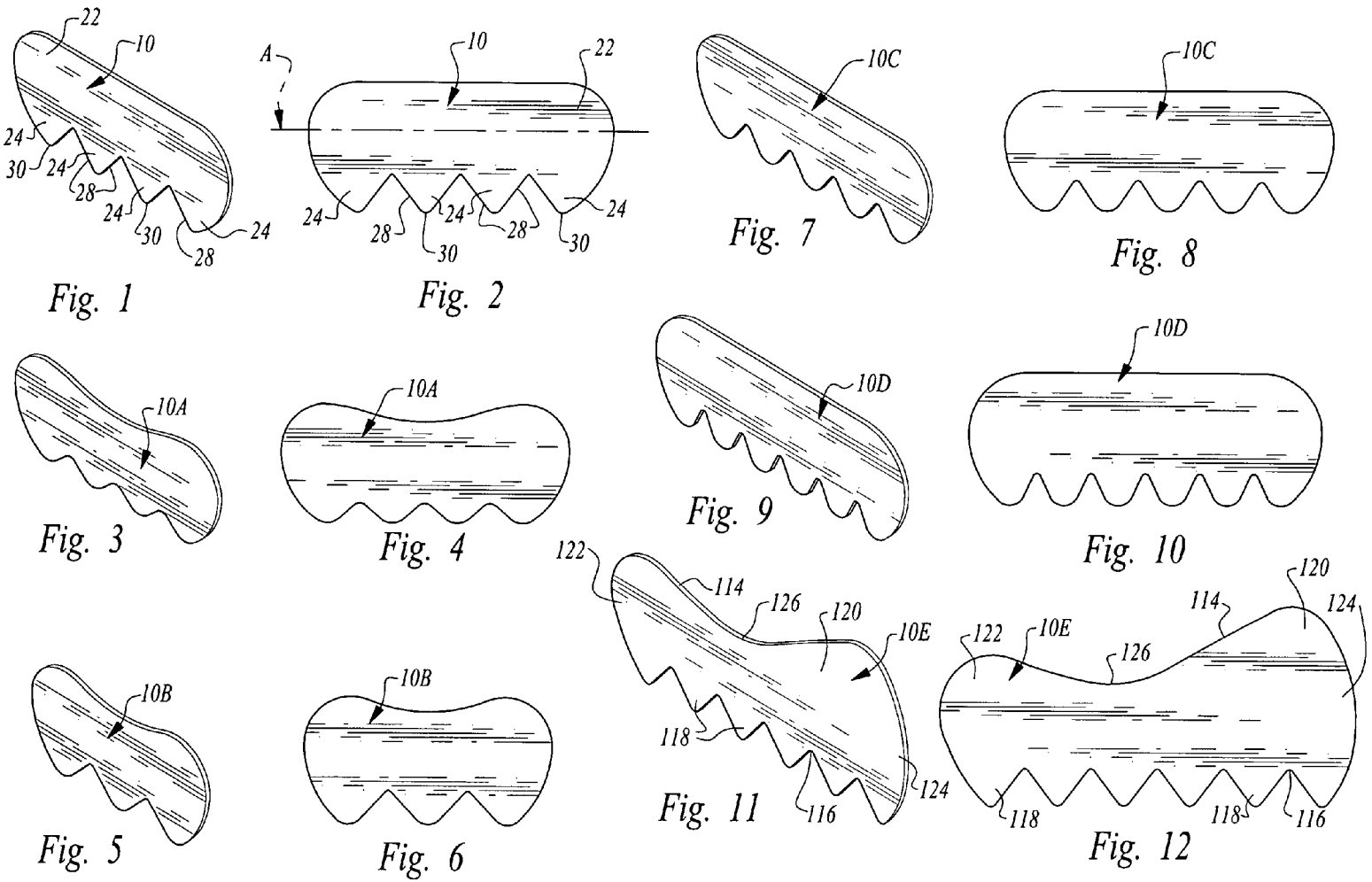
FIG. 1 is a perspective view of a first embodiment of pick constructed in accordance with the teachings of the present invention.
FIG. 2 is a front, elevation view of the pick of FIG. 1.
FIG. 3 is a perspective view of a second embodiment of pick.
FIG. 4 is a front, elevation view of the embodiment of FIG. 3.
FIG. 5 is a perspective view of a third embodiment of pick.
FIG. 6 is a front, elevation view of the pick of FIG. 5.
FIG. 7 is a perspective view of a fourth embodiment of pick.
FIG. 8 is a front, elevation view of the pick of FIG. 7.
FIG. 9 is a perspective view of a fifth embodiment of pick.
FIG. 10 is a front, elevation view of the pick of FIG. 9.
FIG. 11 is a perspective view of a sixth embodiment of pick.
FIG. 12 is a front, elevation view of the pick of FIG. 11.

Hand-held pick 10 includes an elongated pick body 22 having a primary axis A (see FIG. 2).

Pick 10 also includes four string engaging protrusions 24 integral with the elongated pick body and extending outwardly from the elongated pick body in a direction generally orthogonal to the primary axis A. Two protrusions 24 are disposed at the ends of the elongated pick body and hereinafter will be referred to as the endmost protrusions.

The protrusions 24 are tapered, being defined by converging protrusion sidewalls, the sidewalls further defining notches 28 between adjacent protrusions. The tapered protrusions have smoothly rounded tips 30 substantially equidistant from the primary axis A.

The hand-held pick 10 is of single-piece construction and is constructed of a material that is rigid enough to pluck strings but is flexible and bendable. A suitable material of such type is plastic sheet material. However, other suitable materials having the desired characteristics may be utilized. In a preferred form of the invention, the material has an elastic memory.

The hand-held pick 10 in the absence of outside bending forces being applied thereto is in a first condition wherein the elongated pick body 22 and the protrusions 24 are disposed in a common plane.

The hand-held pick is flexible and bendable upon application of bending forces thereto to cause the pick to assume a second condition wherein the pick body forms a bend generally orthogonal to the primary axis A with at least some of the protrusions 24 displaced relative to one another and not disposed in a common plane. Along with FIGS. 1 and 2, FIG. 13, among others, show the pick in the first condition. FIGS. 14 and 15 show the pick 10 in the second condition wherein a bend is formed. FIG. 14 illustrates in dash line a user's hand employed to bend the pick in one direction and FIG. 15 shows the user's hand bending the pick in the opposite direction.

If the pick is formed of material having an elastic memory, the pick returns to its first condition when outside bending forces are removed therefrom.

The guitar 14 or other stringed instrument can be played with the pick in either the first (straight) condition or in the second (bent) condition merely by changing the manual forces applied thereto during playing. The musician may make this change while actually playing to achieve different effects and results by changing string contact. Furthermore, the magnitude of the bend may be varied and the strings plucked differently during playing simply by varying the bending forces applied thereto. It will be appreciated that these capabilities provide a wide variety of musical effects, including those set forth above in the Disclosure of Invention section above.

FIG. 16 shows the pick 10 being swept across the strings 18 of guitar 14, the pick being shown in its first or straight condition. The tapered protrusion distal end portions 26 of the pick are spaced from one another distances enabling a plurality of the strings, which are generally disposed in a common plane, to be simultaneously engaged and plucked by all of the protrusions when the primary axis A is positioned generally parallel to the common plane occupied by the strings and the pick is laterally disposed relative to the strings, conditions illustrated in FIG. 16. FIG. 17 provides a representative diagrammatic illustration of finger locations of the player's hand that is not holding the pick along the neck of the guitar and strings on the neck.

FIG. 18 shows the hand-held pick 10 being swept in the opposite direction and, like the situation in FIG. 16, with all four protrusions 24 in simultaneous engagement with strings 18. In FIG. 18 the guitar 14A does not have a sound hole, being for example an electric guitar.

Figure 19:
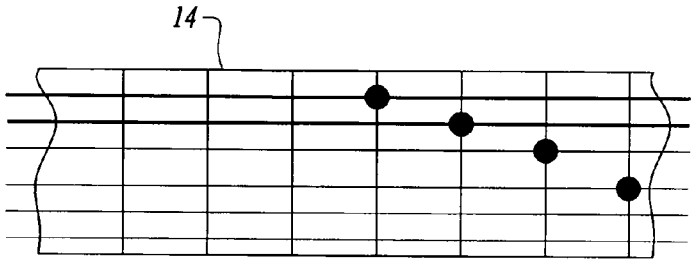
FIG. 19 is a view similar to FIG. 17, illustrating diagrammatically another representative example of finger placement on the strings on the neck while playing.

FIG. 19 is another diagrammatic illustration showing representative finger positioning on the strings at the neck of the guitar depicting fingers on all four strings engaged by the pick in the FIG. 18 illustration.

Figure 20:
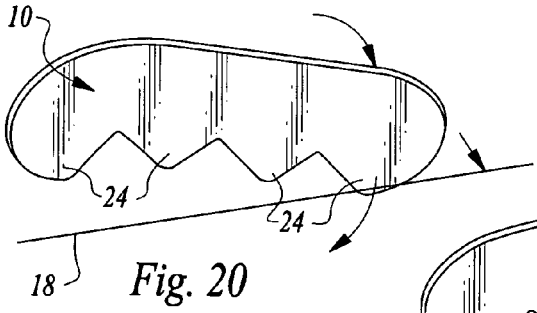
FIG. 20 is a perspective view illustrating the pick embodiment of FIG. 1 in unbent condition tilted or canted with an endmost protrusion of the pick initially engaging a single string.
Figure 21:
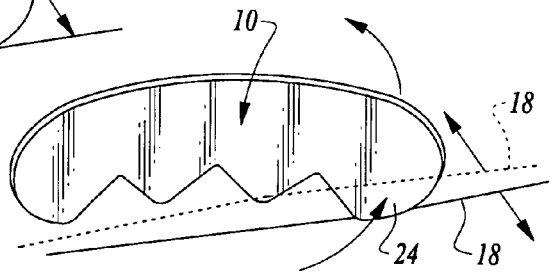
FIG. 21 is a view similar to FIG. 20, but showing the pick bent and releasing the string displaced by the single endmost protrusion during plucking.
Figure 22:
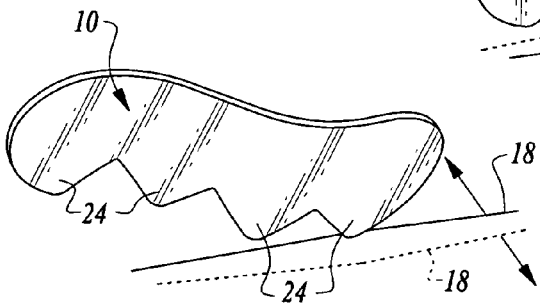
FIG. 22 is a perspective view of the first pick embodiment bent and canted relative to the single string after release of the string.
Figure 23:
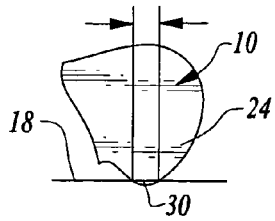
FIG. 23 is a diagrammatic view illustrating positioning of the endmost protrusion in the position illustrated in FIG. 20.
Figure 24:
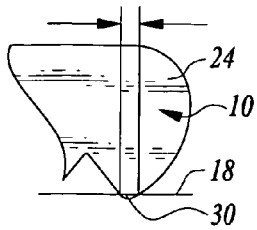
FIG. 24 is a view similar to FIG. 23, but illustrating the endmost protrusion with the string at the very tip thereof at the time of string release as shown in FIG. 21.

FIG. 20 shows pick 10 canted or tilted so that one of the endmost protrusions initially engages a single string 18. If single string picking is desired, this can be accomplished with a simple turn of the wrist. FIG. 23 shows the relationship between the endmost protrusion and the string at this stage wherein the area designated by the two arrows illustrates the contact area between the endmost protrusion and the string. FIG. 21 shows the string displaced by the pick being bent. As bending proceeds, the displaced string approaches the tip 30, and the contact between the pick and string diminishes (as shown in FIG. 24) and the string is released by slipping under the tip. FIG. 22 shows the string engaged by the opposed side of the endmost protrusion 34 and being displaced and plucked in the opposite direction.

It will be appreciated that a hand-held pick constructed in accordance with the teachings of the present invention may be of any suitable configuration. FIGS. 3 and 4 illustrate a second pick embodiment 10A. FIGS. 5 and 6 illustrate a third embodiment 10B. FIGS. 7 and 8 illustrate a fourth embodiment 10C.

FIGS. 9 and 10 illustrate a fifth embodiment 10D.

FIGS. 11 and 12 illustrate a sixth embodiment 10E.

Pick 10E includes a double-ended elongated pick body 112 of single-piece construction having a primary axis and an outer periphery including a top edge 114 and a bottom edge 116.

A plurality of string engaging protrusions 118 extend downwardly from the bottom edge of the pick body in a direction generally orthogonal to the primary axis. The protrusions are tapered and defined by converging protrusion sidewalls further defining notches between adjacent protrusions.

The pick body has smooth, opposed side surfaces 120 (only one of which is illustrated) for simultaneous engagement by tips of a user's fingers. The pick body further includes smoothly curved, spaced, enlarged pick body end portions 122, 124 defining a recess 126 therebetween at the top edge of the pick body. The recess 126 is for receiving the fingers of the user between the user's thumb and little finger while the opposed side surfaces 120 are simultaneously engaged by the user's fingertips. This assists the user in properly placing his or her fingers on the pick. Furthermore, the pick is stabilized in position on the hand at the proper location during use. One of the end portions (preferably the larger of the two, end portion 124) is properly positioned relative to the user's thumb and provides an expanded or enlarged bearing surface engaged by the thumb when exerting bending forces on the pick. The length of the pick is such as to allow engagement thereof by all five fingers. The user's little finger is usually positioned in engagement with the same side surface 120 engaged by the thumb.

As is the case with the other hand-held pick embodiments described above, pick 10E, in the absence of outside bending forces being applied thereto, is in a first condition wherein the pick body and the protrusions are disposed in a common plane. The pick is flexible and bendable upon application of simultaneous bending forces thereto by a user's fingers on the smooth, opposed side surfaces to cause the pick to assume a second condition wherein the pick body forms a bend generally orthogonal to the primary axis with at least some of the protrusions displaced relative to one another and not disposed in a common plane. The hand-held pick virtually instantaneously returns to its first condition, the straight condition, when the finger applied bending forces are removed therefrom. Thus, the pick is highly responsive to differences in hand pressure to assume alternative desired configurations.

Figure 25:
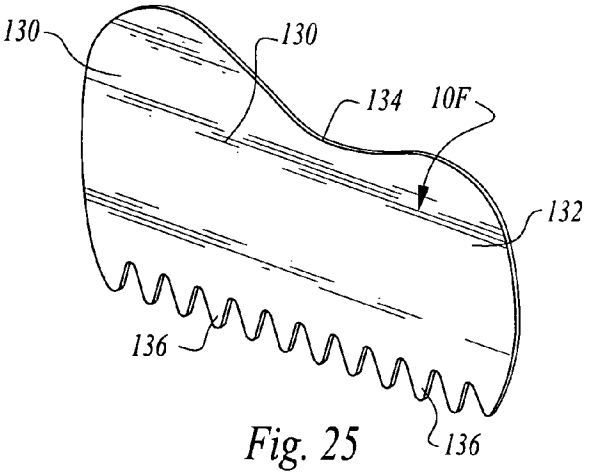
FIG. 25 is a perspective view of a seventh embodiment of pick.
Figure 26:
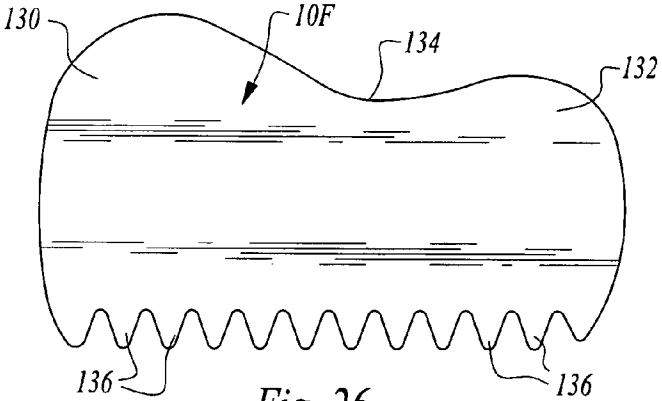
FIG. 26 is a front, elevation view of the pick of FIG. 25.

Pick 10F shown in FIGS. 25, 26 is an embodiment similar to that of FIGS. 11, 12 as just described, incorporating a pick body 130 having enlarged end portions 130, 132 forming a finger accommodating recess 134. Pick 10E includes a larger number of teeth or protrusions 136 having the configuration of blunt end wedges having notches therebetween.

Figure 27:
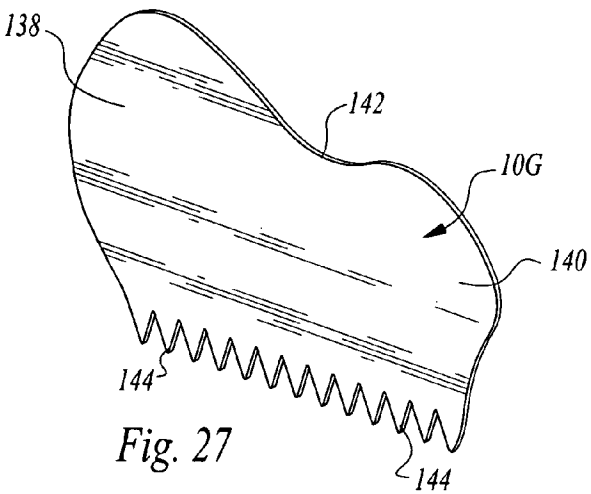
FIG. 27 is a perspective view of an eighth embodiment of pick.
Figure 28:
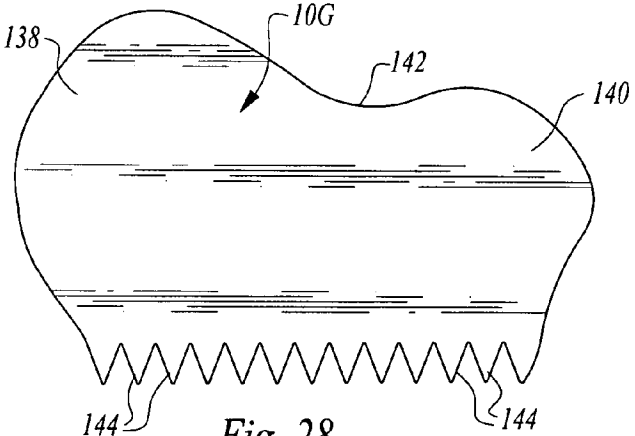
FIG. 28 is a front, elevation view of the pick of FIG. 27.

FIGS. 27 and 28 illustrates a pick 10G also having enlarged end portions, end portions 138, 140 forming a recess 142. Projections or teeth 144 are in the form of sharp ended wedges having notches therebetween.

The invention claimed is:

1. A hand-held pick for playing guitars and other musical instruments having a plurality of strings, said hand-held pick being constructed of bendable material having an elastic memory and including a double-ended elongated pick body of single piece construction having a primary axis and an outer periphery including a top edge and a bottom edge; and a plurality of string engaging protrusions integral with said elongated pick body and extending downwardly from the bottom edge of said elongated pick body in a direction generally orthogonal to said primary axis, said protrusions being tapered and defined by converging protrusion side walls further defining notches between adjacent protrusions, said elongated pick body having smooth, opposed side surfaces within said outer periphery for simultaneous engagement by finger tips of a user's fingers, and said elongated pick body further including smoothly curved spaced, enlarged pick body end portions defining a recess therebetween at the top edge of said elongated pick body, said recess configured and positioned for receiving the fingers of the user between the user's thumb and little finger while the opposed side surfaces are simultaneously engaged by said finger tips, said hand-held pick in the absence of outside bending forces being applied thereto being in a first condition wherein said elongated pick body and said protrusions are disposed in a common plane, and said hand-held pick being flexible and bendable upon application of simultaneous bending forces thereto by a user's fingertips on said smooth, opposed side surfaces to cause said hand-held pick to assume a second condition wherein said elongated pick body forms a bend generally orthogonal to said primary axis with at least some of said protrusions displaced relative to one another and not disposed in a common plane, said hand-held pick returning to said first condition due to the elastic memory of said bendable material when said bending forces are removed therefrom.

2. The hand-held pick according to claim 1 wherein said protrusions have protrusion tips substantially equidistant from said primary axis.

3. The hand-held pick according to claim 1 wherein said pick body and said protrusions are jointly formed from a single piece of bendable material.

4. The hand-held pick according to claim 3 wherein said bendable material is plastic sheet material.

5. The hand-held pick according to claim 2 wherein the protrusion tips are spaced from one another distances enabling a plurality of strings of a musical instrument generally disposed in a common plane to be simultaneously engaged and plucked by a plurality of protrusions when said primary axis is positioned generally parallel to the common plane occupied by said strings and laterally disposed relative to said strings.

6. The hand-held pick according to claim 2 wherein said protrusion tips are smoothly rounded.

7. The hand-held pick according to claim 2 wherein said protrusion tips are pointed.

8. The hand-held pick according to claim 5 wherein said protrusions include two endmost protrusions individually selectively alternatively engageable with a single string when said hand-held pick is canted to position said primary axis at an angle relative to the common plane occupied by said strings.

* * * * *